US005708239A

United States Patent [19]

Konda et al.

[11] Patent Number: 5,708,239

[45] Date of Patent: Jan. 13, 1998

[54] ELECTRICAL CONTACT BREAKER SWITCH

[75] Inventors: Kazumoto Konda; Sho Miyazaki, both of Yokkaichi, Japan

[73] Assignee: Sumitomo Wiring Systems, Ltd., Japan

[21] Appl. No.: 643,982

[22] Filed: May 7, 1996

[30] Foreign Application Priority Data

May 8, 1995 [JP] Japan ..... 7-135961

[51] Int. Cl.[6] ..... H01H 1/54

[52] U.S. Cl. ..... 200/1 R; 200/17 R

[58] Field of Search ..... 200/1 R, 17 R, 200/6 R, 6 BA, 6 BB, 6 C, 16 R; 335/196, 197

[56] References Cited

U.S. PATENT DOCUMENTS 3,686,601 8/1972 Kaczmarek et al. ..... 337/66

3,784,771 1/1974 Olsen ..... 200/82 B 5,414,231 5/1995 Sato et al. ..... 200/1 R 5,525,769 6/1996 Anderson ..... 200/1 R

FOREIGN PATENT DOCUMENTS 7-65670 3/1995 Japan .

*Primary Examiner*—Adolf Berhane

*Attorney, Agent, or Firm*—Banner & Witcoff, Ltd.

[57] ABSTRACT

Electrical plate terminals 18 and 21 are provided on the left and right sides of a main switch box. Between these is provided a switch mechanism chamber 15 in which associated rod terminals 26 and 27 project from right and left. A connecting tube 28 is provided between the rod terminals 26 and 27 and is mounted for sliding movement in conjunction with pivotal movement of a lever 12 so as to connect and disconnect the terminals 27 and 28. The switch mechanism has a low operating force.

8 Claims, 7 Drawing Sheets

ELECTRICAL CONTACT BREAKER SWITCH

FIELD OF INDUSTRIAL APPLICATION

The present invention relates to a breaker switch and more particularly to an electrical breaker switch in which the switch mechanism is improved.

BACKGROUND OF THE INVENTION

A breaker switch is well known in the electrical systems of automobiles for breaking connection between the battery and associated electrical devices, for example for maintenance. Typically, as shown in FIG. 12 herein, a pair of electric terminal plates 2 and 3 are fixed on a base plate 1, the plates being separated by a specific distance. Ends of electric wires 4 are fixed to the terminal plates 2 and 3 by means of respective crimped terminals. The electrical terminal plate 3 carries a plate-shaped lever 6 that is made from conducting material and that is pivotable about axis 6*a*. A resilient contact 7 is provided on the other electrical terminal plate 2 that is open at the top and which grips the lever 6 on both sides when the lever 6 is engaged therewith. In operation, when the lever 6 is lowered it is forced between the resilient contacts 7, and electrical contact is established between the two terminal plates 2 and 3 via the lever 6. When the lever 6 is raised, electrical contact is broken.

In the above kind of configuration whereby the lever is pivoted so as to force it between resilient contacts, electrical contact can be broken if the anterior extremity of the lever is raised upwards even slightly, since the lever separates from the contacts. For this reason, in the conventional case, it became necessary to increase the resilient force of the contacts in order to prevent the lever from being inadvertently disengaged. As a result engagement of such a lever is difficult as a larger force is required.

Furthermore operation of this kind of lever may place the plate contacts 2, 3 under strain, and also the wires 4; this is undesirable since it may lead to a broken contact, which is at best inconvenient or which may result in a fire risk in a high current installation.

The present invention has been developed after taking into consideration the above circumstances, and aims at providing a breaker switch in which a relatively low engagement force is sufficient.

SUMMARY OF THE INVENTION

According to the invention there is provided an electrical contact breaker switch comprising a housing having first and second terminals electrically insulated from each other, wherein the terminals are co-axial and are relatively movable towards and away from one another to make and break electrical contact, one of the terminals having an opening adapted to receive the other terminal, and a resilient contact member being provided within said opening for engagement with the outer surface of the other terminal.

In such a switch, electrical contact is not broken if the electrical terminals accidentally moved slightly in the removal direction. Accordingly, unlike the conventional case, there is no need to increase the resilient force of the contacts in order to prevent slight movement. As a result, an effect is achieved whereby the switching operation can be carried out with a light touch.

The terminals are preferably defined by a co-axial plug and socket arrangement having sufficient depth of engagement to avoid accidental disconnection.

One or both terminals may be relatively movable. In the preferred embodiment one terminal is movable and is defined by a fixed pin and a movable tubular member co-axial therewith. The tubular member includes internal resilient contacts to engage the fixed pin and provide electrical continuity. Preferably, the other terminal is also a fixed pin, and the tubular member is cylindrical.

Alternatively the movable member can be a pin and the terminals can be tubular.

BRIEF DESCRIPTION OF DRAWINGS

Other aspects of the invention will be apparent from the following description of several preferred embodiments illustrated by way of example only with reference to the accompanying drawings in which.

DESCRIPTION OF PREFERRED EMBODIMENT

Figure 1:
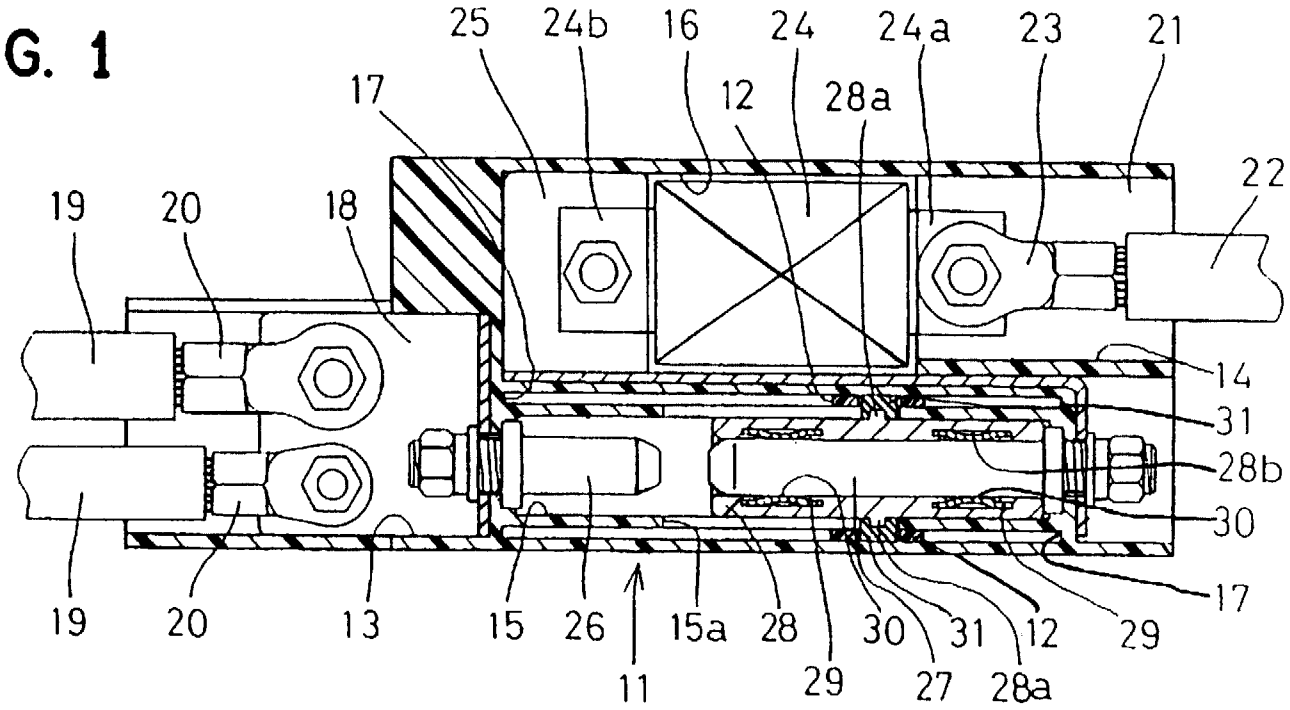
FIG. 1 is a longitudinal cross-section through the first embodiment of the invention.
Figure 4:
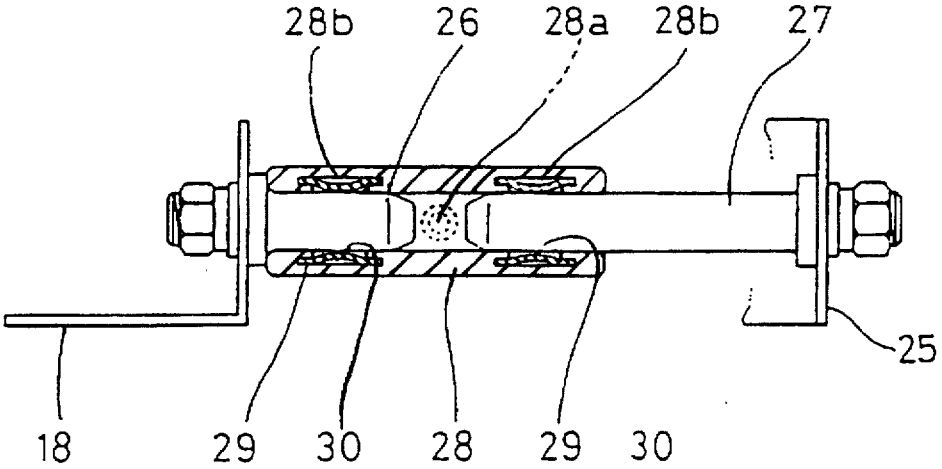
FIG. 4 is a partly-cut away side view of the first embodiment showing the electrically connected condition.
Figure 5:
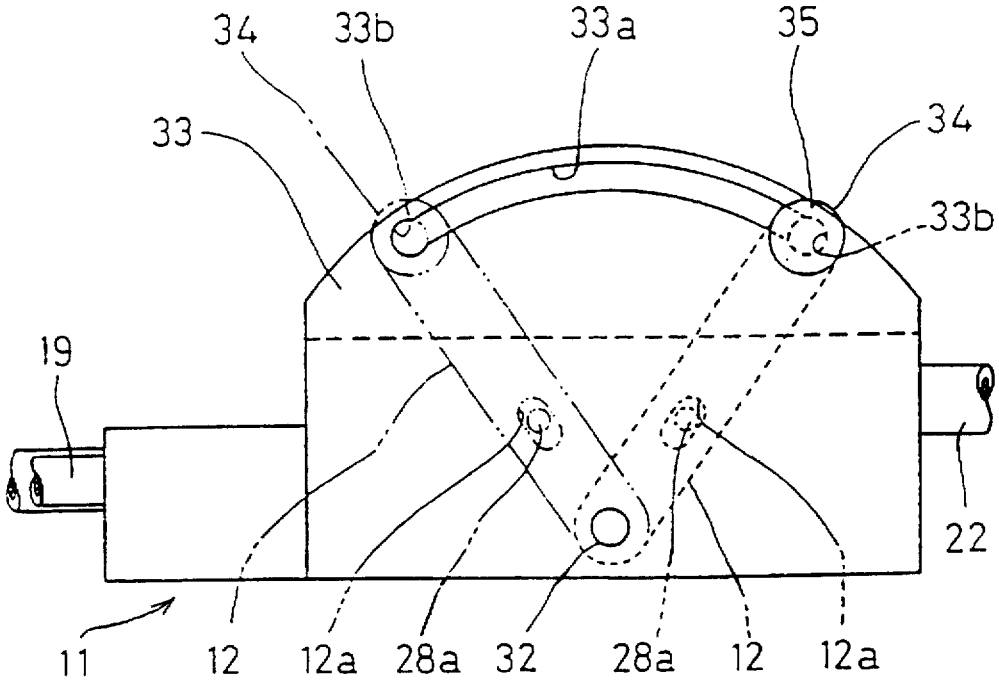
FIG. 5 is a front elevation of the main switch box of the first embodiment.
Figure 6:
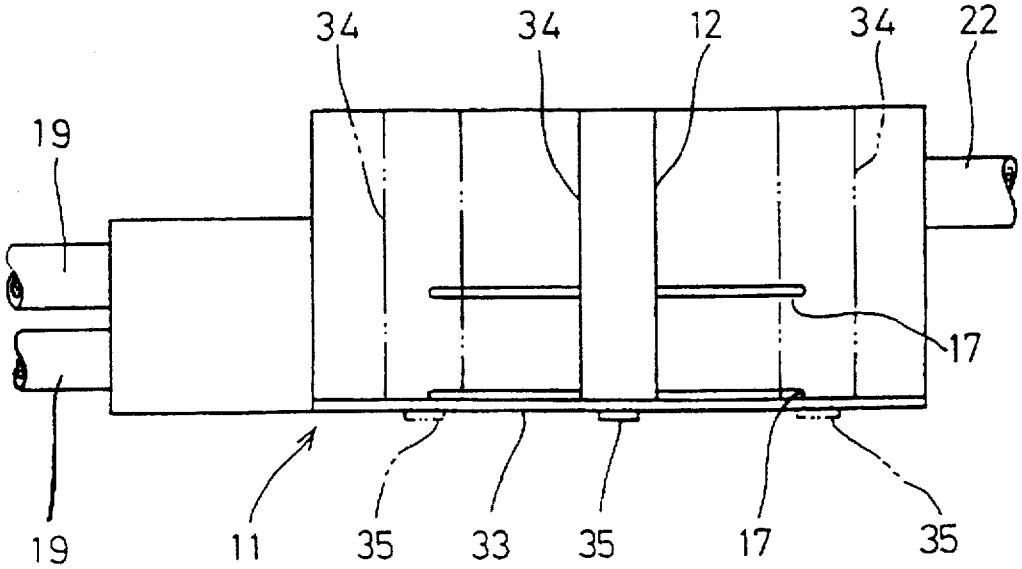
FIG. 6 is a view from above of the main switch box of the first embodiment.
Figure 7:
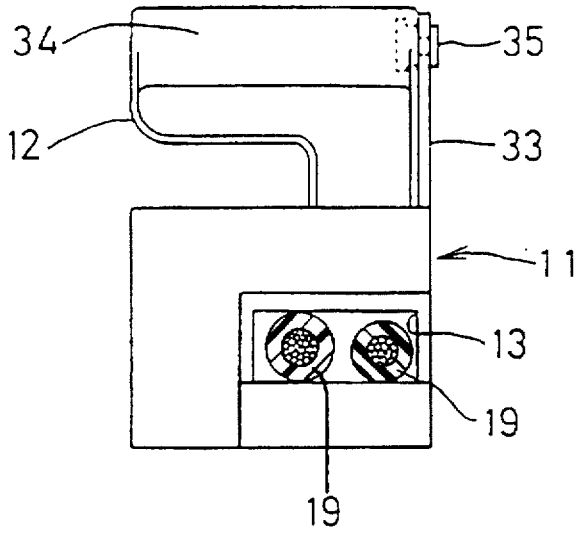
FIG. 7 is a side elevation of the main switch box of the first embodiment.

The first embodiment of a breaker switch of the present invention is explained hereinbelow, with reference to FIGS. 1 to 9. As shown in FIGS. 6 and 7, a breaker switch of the present embodiment comprises a main switch box 11 and a lever 12. As shown in FIG. 1, the box 11 is divided to the left and right into electrical terminal insertion chambers 13 and 14. Other portions of the box (located above and below respectively in FIG. 1) are partitioned into a switch mechanism insertion chamber 15 and a fuse insertion chamber 16, as illustrated. The upper face of the switch chamber 15 has a pair of opposed lever insertion grooves 17. The lower extremity of the foot of lever 12 is located within the grooves 17.

Figure 2:
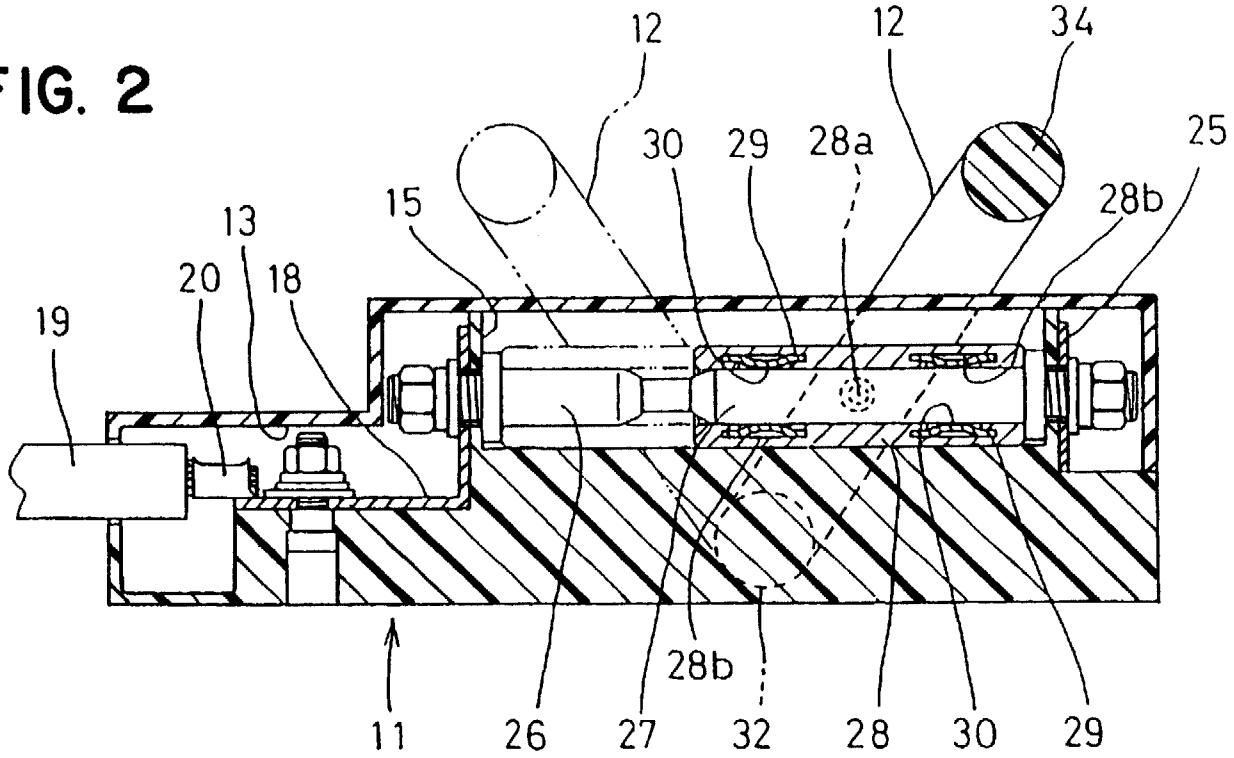
FIG. 2 is a transverse cross-section through the first embodiment.

As shown in FIG. 2, an L-shaped electrical terminal plate 18 is provided in the terminal insertion chamber 13. Attached on one end of the plate 18 are the ends of electric wires 19 connected to an electrical device, the electrical wires 19 being fixed down via terminal fittings 20. The other end of the electrical terminal plate 18 rises upwardly and is fixed via a nut to the left side wall of the switch chamber 15 along with the base member of a rod type terminal 26, to be described later. As a result, the electrical wires 19 are electrically connected to the terminal 26.

The terminal 26 passes through and projects out from the left side wall of the switch chamber 15, as illustrated.

As shown in FIG. 1, the terminal insertion chamber 14 has a flat plate-like electrical terminal 21. The end of an electrical wire 22 for connection to the battery is attached via a terminal fitting 23.

The fuse insertion chamber 16, has a fuse box 24 inserted therein. Inside the fuse box 24 is a fuse. One end terminal 24a projecting to the right is fixed to the terminal plate 21 along with the terminal fitting 23. Another end terminal 24b projects from the right side face of the fuse box 24 and is fixed on to one end of a connecting fitting 25 and to the base portion of the main box 11. The other end of the terminal 25 extends in the right-hand direction and is fixed by a nut to the right side wall of the switch chamber 15 along with the base member of a rod type terminal 27, to be described later. In this way, the electrical wire 22 is electrically connected to the rod terminal 27 via the fuse. The rod terminal 27 projects through the right side wall of the switch chamber 15 as illustrated.

The rod terminals 26 and 27 are metallic and are separated by a small distance. The length of the rod terminal 27 projecting from the right side is approximately twice that of the rod terminal 26 projecting from the left. A cylindrical connecting tube 28 is fitted in a slidable manner to the rod terminal 27 to collectively form a two-part terminal. This connecting tube 28 is made from electrically conductive metal and its length is arranged to be approximately the same as that of the rod terminal 27. Moreover, the inner peripheral face located slightly inwards from both the open ends of the connecting tube 28 has continuous internal attachment grooves 28b which contain contact members 29. These contact members 29 are made from an electrically conducting metal plate formed to approximately a C section. A plurality of resilient contacts 30 is formed on each of the contact members 29 at an equal pitch along the peripheral direction thereof, and accordingly bending to fit the attachment grooves 28b is possible. The resilient contacts 30 are inserted in a manner so as to curve into the gap formed between the connecting tube 28 and the rod terminals 26, 27; as a result, the contacts 30 can slide against the external faces of the rod terminals 26 and 27 as the connecting tube 28 is slid to the left and to the right.

Approximately in the middle of the external face of the connecting tube 28 project opposite guiding projections 28a in the up-down direction of FIG. 1. Each of the guiding projections 28a extend into a corresponding lever insertion groove 17 via guiding grooves 15a formed on upper and lower side walls of the switch chamber 15. These guiding grooves 15a are relatively long and thin and extend in the left-hand direction as viewed. Each gliding projection 28a has a resin cap 31 placed thereon.

The lever 12 rises up so as to sit astride the switch chamber 15. Both its feet are supported for arcuate movement about axis 32 via the lever insertion grooves 17. Accordingly, the lever 12 is pivotable to the left and right directions with respect to the main box 11. Moreover, as shown in FIG. 5, connecting holes 12a are formed on the lever 12 approximately to the centre of the legs. Into these connecting holes 12a are slidably inserted the caps 31 of the projections 28a. As a result, when the lever 12 is pivoted in the left-right direction, the guiding projections 28a move within the guiding holes 15a, and consequently the connecting tube 28 slides to the left and right.

Figure 8:
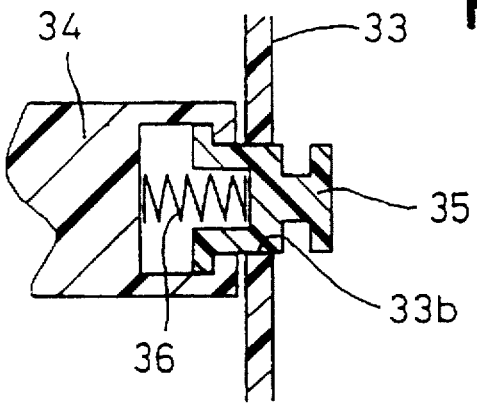
FIG. 8 is a partial cross-section showing the locked state of the lever of the first embodiment.
Figure 9:
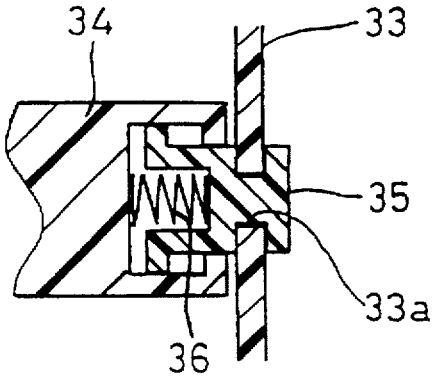
FIG. 9 is a partial cross-section showing the unlocked state of the lever of the first embodiment.

As shown in FIG. 5, a face plate 33 of the main box 11 extends upwards and has an arc-shaped lever guiding slot 33a formed in it. The arc shape is centred on the axis 32. The two extreme ends of the guiding slot 33a have locking holes 33b therein which have a dimension slightly larger than the width of the slot 33a. The upper end of the lever 12 has a gripping member 34 between the legs thereof and, as shown in FIG. 8, an operating button 35 that can be depressed. This operating button 35 is arranged so that its base member has approximately the same outer diameter as the diameter of the locking hole 33b. Further, its mid-portion has approximately the same outer diameter as the width of the slot 33a. The operating button 35 is resiliently loaded by means of a spring 36. As shown in FIG. 9, the base member portion of the operating button 35 fits into the locking hole 33b to give a locked state.

The operation of the present embodiment is now described. In order that the breaker switch be in an electrically conducting state, first the lock of the lever 12 is released by depressing the operating button 35. In this state if the lever 12 is pivoted slightly towards the left the operating button 35 engages the slot 33a. Once engaged in the slot 33a, the operating button 35 can be released.

Further pivoting of the lever 12 causes the connecting tube 28 to slide to the left since the guiding projections 28a are pushed to the left by means of the connecting holes 12a. The rod terminal 26 engages within the left-hand portion of the connecting tube 28 of the opposing. The terminal contact 30 makes resilient contact with the external face of the terminal 26 by bending outwardly. When the lever 12 reaches the locking hole 33b on the left side of the slot 33a, the extreme left end of the connecting tube 28 touches the left wall of the switch chamber 15 and the rod terminals 26 and 27 are in electrical contact (FIG. 4). Accordingly, electrical contact is established between the terminal plates 18 and 21. The operating button 35 of the lever 12 snaps into the locking hole 33b and the lever 12 is locked against movement (FIG. 8).

Figure 3:
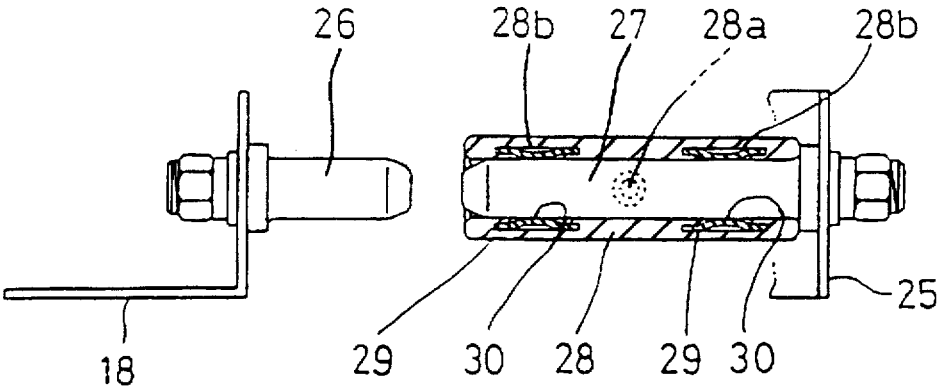
FIG. 3 is a partly-cut away side view of the first embodiment showing the electrically disconnected condition.

Next, in order to break electrical contact, the operating button 35 is pressed in the way as described above and the lever 12 is released and pivoted to the right. Upon doing this, the guiding projections 28a are pushed to the right, and as a result, the connecting tube 28 slides to the right and touches the right wall of the switch chamber 15. The connecting tube 28 separates completely from the terminal rod 26 and electrical conductivity between the electrical terminal plates 18 and 21 is broken (FIG. 3). The operating button 35 engages the locking hole 33b to retain the lever against movement. In the event that the lever 12 is released by accident and pivots slightly to the right, the connecting tube 28 only slides slightly in the disconnection direction but electrical contact is maintained by means of the resilient contacts 30. As a result, unlike the conventional case, there is no need to increase the resilient force of the contacts in order to prevent electrical contact from being broken if the lever 12 in the electrically connected state is accidentally moved. Accordingly, insertion of the connecting tube 28 into the rod terminal 26 and removal thereof can be effected by means of a low force and, consequently, a favourable effect is achieved in that switch operation becomes easy.

Furthermore, in order to operate the switch only the connecting tube 28 of one terminal needs to be moved, and there is no need to slide the rod terminals 26 and 27. Accordingly, the electrical wires 19 and 22 connected to the electrical terminal plates 18 are not pulled when the switch is operated and, as a result, even in the case where the electrical wires 19 and 22 are thick the switch can be operated with a low force.

Although the first embodiment described above has a configuration whereby the switch mechanism is such that the rod terminals are fixed so as to project from the left and right sides and the connecting tube is provided so as to slide between the rod terminals, the configuration may be such that there is no connecting tube, and a slidable tubular terminal and a rod terminal that fit mutually are provided.

Figure 10:
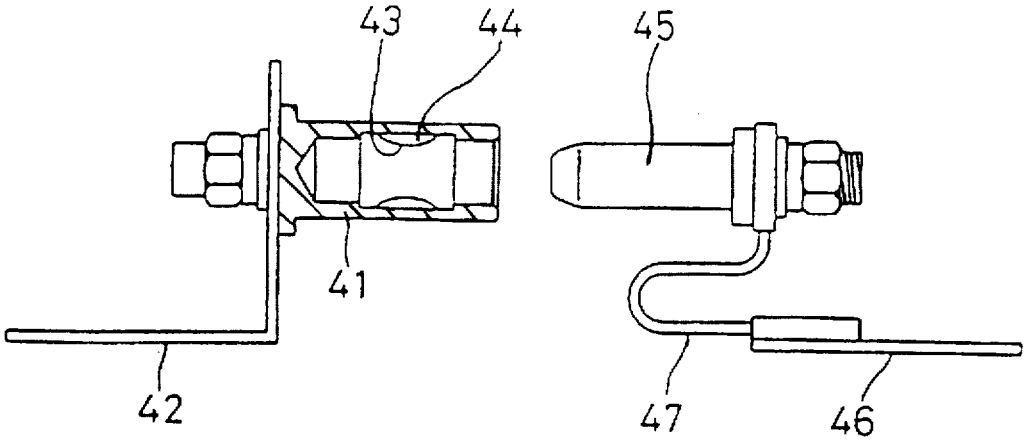
FIG. 10 is a side elevation showing an electrically disconnected state of a second embodiment of the invention.

For example, as shown in FIG. 10, a tubular terminal 41 is fitted with a nut to the left wall of a switch box (not shown) and to an electrical plate terminal 42. As in the case of the first embodiment, the tubular terminal 41 has contact members 44 whose inner sides have a plurality of resilient contacts 43. Moreover, on the right side of the switch chamber, a rod terminal 45 is provided so as to be slidable in the left-right direction and an electrical plate terminal 46 is connected thereto via a braided wire 47. Furthermore, although not shown, the mechanism for sliding the rod terminal 45 to the left and right is effected by means of a lever as in the first embodiment.

Figure 11:
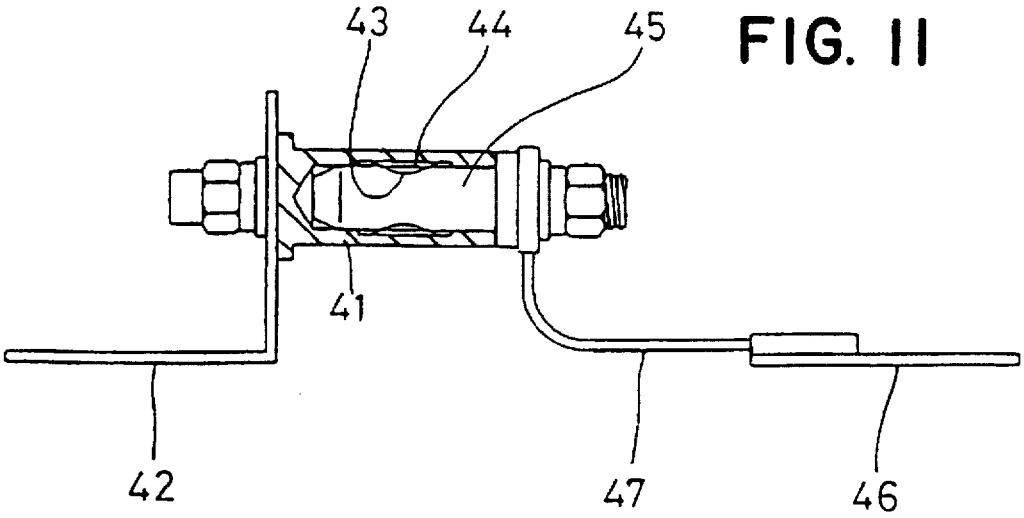
FIG. 11 is a side elevation showing an electrically connected state of the second embodiment.
Figure 12:
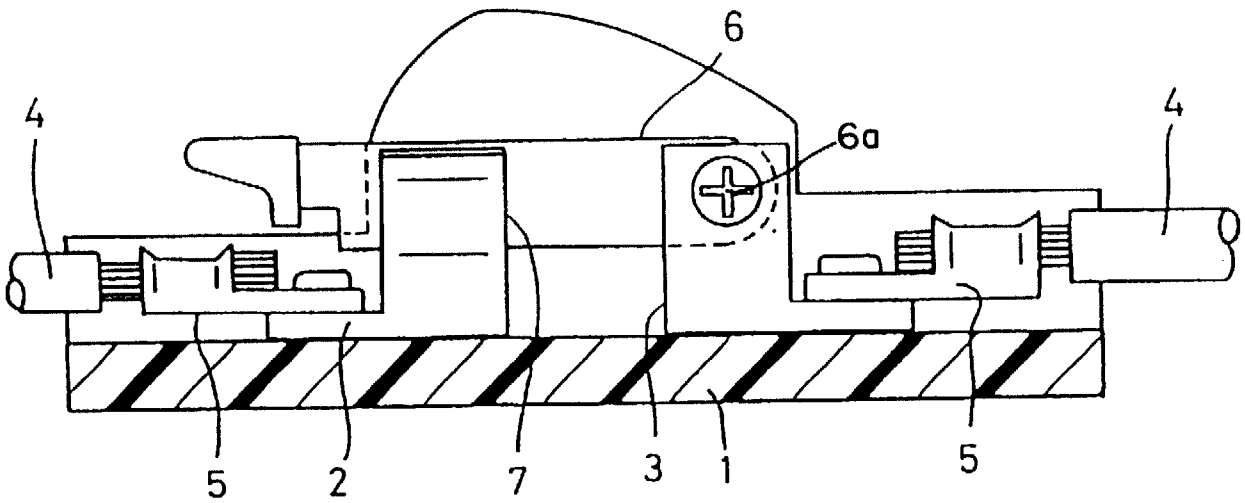
FIG. 12 PRIOR ART
FIG. 12 is a cross-section through a prior art breaker switch.

When the rod terminal 45 is slid in the leftward direction, the rod terminal 45 is pressed inside the tubular terminal 41 and electrical contact is established between the terminal plates 42 and 46 (FIG. 11). When the rod terminal 45 is slid in the rightward direction, the rod terminal 45 comes out from the tubular terminal 41 and electrical contact is broken (FIG. 10).

In the case of such an embodiment as well, even if the rod terminal 45, which is in the electrically connected state, is slid slightly in the removal direction, there is no possibility of the electrical connection between the plates 42 and 46 being broken as long as the rod terminal 45 is not completely separated from the tubular terminal 41. As a result, unlike the conventional case, there is no need to increase the elastic force of the elastic contacts. Consequently, operation can be carried out with a light operating force. Moreover, even though the rod terminal 45 is slidable, the plate terminal 46 can be fixed by using the braided wire 47. As a result, the electrical wire connected to the electrical terminal plate 46 is not pulled when the switch is operated, and accordingly the switch can be operated with a light touch.

On the other hand, the first embodiment is more suitable in a high current situation, since the braided wire is not used. If a braided wire is used in a high current situation, it would have to be thick, and operation would become difficult because a thick braided wire is difficult to bend.

The present invention is not limited to the embodiments described above. For example, the variations described below also constitute embodiments that lie within the technical range of the present invention.

Although in the first embodiment the pivoting operation of a lever 12 is used to slide the connecting tube 28, the lever may equally be configured to slide to the left and right directions, thereby making the connecting tube slide. In such a case, since the lever does not have an arcuate movement, the height of the apparatus as a whole can be lowered.

Further, the connecting tube can be without a through hole or the connecting tube can be rod-shaped with each electrical terminal having a terminal insertion hole formed therein. Alternatively, one end of the connecting tube can be rod-shaped and the other end can have a terminal insertion hole formed therein, and a terminal insertion hole and a rod terminal can be formed on the respective electrical terminal sides facing the two sides of the connecting tube.

Furthermore, the connecting tube can be fixed, and the two electrical terminals can be slidable. Alternatively, it can be arranged so that the connecting tube and the two electrical terminals move, and so on.

Apart from this, the present invention may be embodies in various ways without deviating from the scope of the appended claims.

We claim:

1. An electrical contact breaker switch comprising a housing having first and second elongate, substantially cylindrical electrical terminals electrically insulated from each other, wherein the terminals are co-axial and are relatively movable towards and away from one another from an engaged to a disengaged condition to make and break electrical contact with each other, one of the terminals having a tubular construction to define an opening adapted to receive the other terminal, and a resilient contact member being provided within said opening in electrical contact with said one terminal and for engagement with the outer surface of the other terminal.

2. A switch according to claim 1 wherein said resilient contact member is located within an internal groove of said one member.

3. A switch according to claim 1 wherein a plurality of resilient contact members are provided.

4. A switch according to claim 1 wherein said one terminal comprises a cylindrical pin and a cylindrical tubular member movable axially thereof.

5. An electrical contact breaker switch comprising a housing having first and second elongate electrical terminals electrically insulated from each other, wherein the terminals are co-axial and are relatively movable towards and away from one another from an engaged to a disengaged condition to make and break electrical contact with each other, one of the terminals having an opening adapted to received the other terminal, and a resilient contact member being provided within said opening in electrical contact with said one terminal and for engagement with the outer surface of the other terminal, wherein said resilient contact member has a plurality of radially inwardly extending resilient contacts and is located within an internal groove of said one terminal.

6. An electrical contact breaker switch comprising a housing having first and second elongate electrical terminals electrically insulated from each other, wherein the terminals are co-axial and are relatively movable towards and away from one another from an engaged to a disengaged condition to make and break electrical contact with each other, one of the terminals having an opening adapted to received the other terminals, and a resilient contact member being provided within said opening in electrical contact with said one terminal and for engagement with the outer surface of the other terminal, wherein one of said terminals is fixed relative to said housing, the other of said terminals being engageable by a lever pivoted on the housing for arcuate movement thereby to move said other terminal relative to said one terminal.

7. A switch according to claim 6 wherein said other terminal is engaged by said lever between the pivot axis of the lever and free end thereof.

8. A switch according to claim 7 wherein said lever includes disengageable latch means engageable when said terminals are in an engaged and in a disengaged condition.

* * * * *